US006389991B1

(12) United States Patent
Morrisson

(10) Patent No.: US 6,389,991 B1
(45) Date of Patent: May 21, 2002

(54) DISPLAY DEVICE

(75) Inventor: Steven B. Morrisson, Varennes (CA)

(73) Assignee: Albums DF Ltée, Longueuil (CA)

( * ) Notice: Subject to any disclaimer, the term of this patent is extended or adjusted under 35 U.S.C. 154(b) by 8 days.

(21) Appl. No.: 09/619,267

(22) Filed: Jul. 19, 2000

(51) Int. Cl.[7] ..... A47B 57/00
(52) U.S. Cl. ..... 108/61; 211/184
(58) Field of Search ..... 108/61, 60; 211/184, 211/42, 43

(56) References Cited

U.S. PATENT DOCUMENTS 305,863 A * 9/1884 Thompson
1,506,204 A * 8/1924 Snoddy
4,782,960 A * 11/1988 Mavrakis
5,415,297 A * 5/1995 Klein et al.

* cited by examiner

*Primary Examiner*—Jose V. Chen
(74) *Attorney, Agent, or Firm*—Goudreau Gage Dubuc

(57) ABSTRACT

An article display device adapted for use with a shelving structure including a flat shelf. The display device includes a curved article retaining element for retaining articles placed side by side on the shelf. The curved article retaining element is spaced above the shelf and is connected to the shelving structure. The display device further includes support members for connecting the retaining curved element to the shelving structure.

28 Claims, 1 Drawing Sheet

DISPLAY DEVICE

FIELD OF THE INVENTION

The present invention relates to a display device. More specifically, the present invention is mainly concerned with a display device used with a shelving structure for displaying retail sales articles such as photo albums.

BACKGROUND OF THE INVENTION

Display devices used with flat shelves to display multiple non-related items which are for sale are well known. Items are usually displayed on shelves using dividers attached to the surfaces of the shelves to support and separate the items. The dividers are spaced apart at predetermined vertical distances from one another.

Most conventional display devices and systems allow for a variety of non-related items having different widths to be displayed adjacent to one another on a shelf. Certain articles such as photo albums have an asymmetrical configuration wherein their backside is greater in dimension than their front side and hence such display devices are inadequate for displaying multiple sets of these types of items.

OBJECTS OF THE INVENTION

The general object of the present invention is therefore to provide an improved display device.

Another object of the invention is to provide a display device free of the above-noted disadvantages.

A further object of the present invention is to provide a display device to be used with a flat shelf for displaying retail sales articles such as photo albums.

SUMMARY OF THE INVENTION

More specifically, in accordance with the present invention, there is provided an article display device adapted for use with a shelving structure comprising a flat shelf, the display device comprising:

a curved article retaining element for retaining articles placed side by side on the shelf, the curved article retaining element being spaced above the shelf and being connected to the shelving structure; and support members for connecting the curved article retaining element to the shelving structure.

Preferably, the articles are photo albums.

Preferably, the curved article retaining element is substantially diagonal and the support members comprise opposite free ends of the retaining element and the shelving structure further comprises a backboard, wherein one free end is mounted to the shelf and the other free end is mounted to the backboard.

Alternatively, the curved article retaining element comprises a substantially horizontal member, wherein one of the support members comprises a leg member mounted to the horizontal member, the leg member being mounted to the shelf.

Preferably, the shelving structure further comprises a backboard and another of the support members comprises a free end of the horizontal member, said free end being mounted to the backboard.

In accordance with another aspect of the present invention, there is provided an article display device adapted for use with a flat shelf having a front edge and a back edge adjacent to a back structure, the display device comprising:

a substantially vertical upstanding portion having a shelf engaging end for being mounted near the front edge of the shelf, the upstanding portion substantially vertically upstanding from the shelf; and a substantially horizontal article retaining portion comprising a back structure-engaging end and spanning a length equal to about the distance between the back structure-engaging end and the upstanding portion, the article retaining portion comprising an article-engaging side having a concavely curved configuration for articles to be engaged thereon, wherein articles to be displayed are placed on the shelf adjacent to one another along the article-engaging side.

Preferably, the back structure-engaging end comprises a connector and the back structure comprises a track rail mounted thereto for slidably receiving the connector.

Preferably, the back structure further comprises an upper shelf having a front edge carrying the track rail. More preferably, the connector comprises a snap member.

Alternatively, the connector comprises a magnet and the back structure comprises a magnetic or metallic portion for mutual magnetic engagement thereof.

Preferably, the shelf comprises a display device receiving portion near the front edge to releasably mount the shelf-engaging end thereto.

Preferably, the display device receiving portion comprises a lined recess near the front edge of the shelf for snuggly fitting the shelf-engaging end therein.

Alternatively, the shelf-engaging end comprises a magnet and the display device receiving portion comprises a metallic or magnetic portion for mutual magnetic engagement.

Preferably, the articles are photo albums.

In accordance with yet another aspect of the invention there is provided an article display device adapted for use with a flat shelf having a front edge and an opposite back edge, the display device comprising:

a substantially vertical upstanding front portion having a free front edge engaging end for being mounted near the front edge of the shelf, the front edge upstanding portion substantially vertically upstanding from the shelf;

a substantially vertical upstanding back portion having a free back edge engaging end for being mounted near the back edge of the shelf, the front back edge upstanding portion substantially vertically upstanding from the shelf; and a substantially horizontal article retaining portion spanning a length equal to about the distance between the front edge and back edge and the upstanding portions, the article retaining portion comprising an article-engaging side having a concavely curved configuration for articles to be engaged thereon, wherein articles to be displayed are placed on the shelf adjacent to one another along the article-engaging side.

Preferably, the shelf comprises a front display device receiving portion near the front edge to releasably mount the front edge end thereto and a back display device receiving portion near the back edge to releasably mount the back edge end thereto.

More preferably, the front and back display device receiving portions comprises respective lined recesses near the front edge and back edge respectively for snuggly fitting the front edge end and the back edge end therein respectively.

Preferably, the articles are photo albums.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Figure 1:
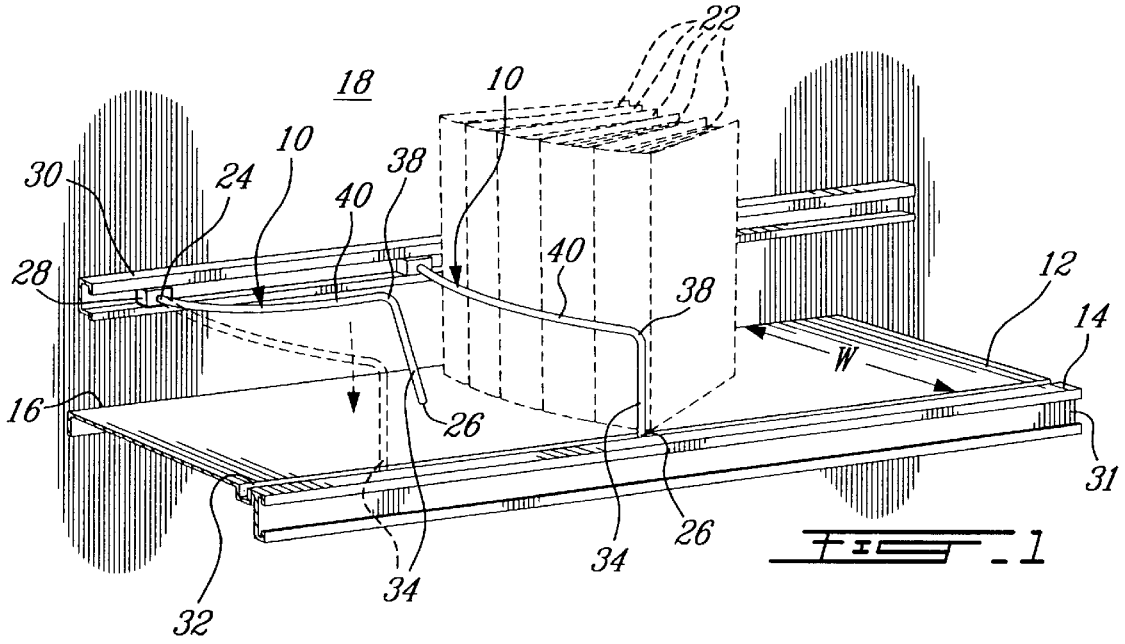
FIG. 1 is a perspective view of the display device according to the present invention being used with a shelf and displaying a set of photo albums.
Figure 2:
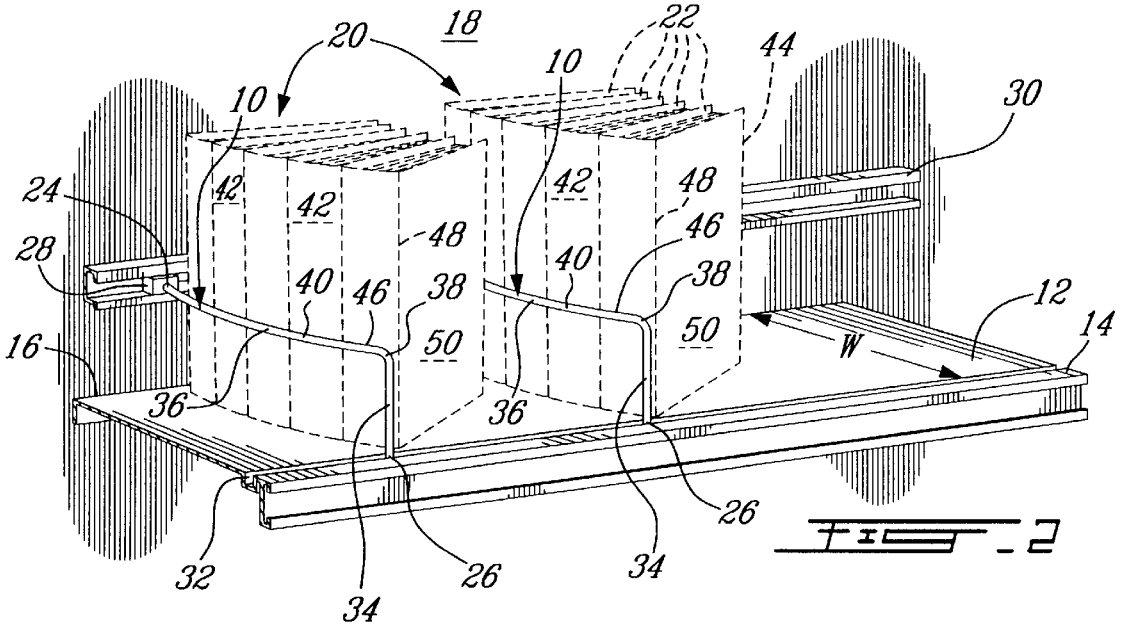
FIG. 2 is a perspective view of the display device of the present invention displaying two sets of photo albums.

With reference to FIGS. 1 and 2 there is shown the display device 10 according to the present invention for use in conjunction with a shelf 12.

The shelf 12 preferably has a flat rectangular configuration and includes a front edge 14 and an opposite back edge 16 adjacent to a back structure 18. The back structure 18 may be a backboard hence, shelf 12 and backboard 18 form a shelving structure. Back structure 18 may also be a wall structure. The flat shelf 12 has a length and width sufficient to place thereon items or articles such as multiple sets 20 of photo albums 22 and other retail sales items at predetermined distances.

The display device 10 includes a curved article retaining element or portion 36 spaced above the shelf 12 and support members 24 and 34 for connecting the curved article retaining element to the shelving structure. The display device 10 may be made of a plastic, metallic or any other suitable material.

Support member 24 may be under the form of a free back structure engaging end 24 and may carry a connector 28 that can be securely received by a track rail 30 mounted on the back structure 18. Of course, other ways of mounting the back structure engaging end 24 to the back structure 18, such as using a perforated backboard (not shown) or a longitudinal perforated member (not shown) mounted to the backboard for the back structure engaging end 24 to be fitted therein, may also be contemplated.

Connector 28 may be provided in a variety of shapes and sizes, such as a snap member for example. The connector is securely and releasably mounted to the track rail 30 and can slide along the rail 30 in order to place the display device 10 at a particular position along the shelf 12. Connector 28 may also be a magnetic member and the track rail 30 may comprise a metallic or magnetic portion for mutual magnetic engagement therewith.

Support member 34 may be in the form of a leg member. In this example the leg member 34 is a vertical upstanding portion 34 mounted to one end of the curved article retaining element 36. Obviously, leg member 34 may be mounted near the middle area of the curved article retaining element 36. In another embodiment the curved article retaining element 36 may comprise a diagonal member (not shown) hence, support member 34 may comprise the bottom free end (not shown) of this diagonal member.

In the non limiting example illustrated herein the leg member or upstanding portion 34 includes a shelf engaging end 26. This shelf engaging end 26 can be snugly fitted within a display device receiving portion 32 preferably, under the form of a lined recess 32 near the front edge 14 of the shelf 12. Again, a variety of ways of mounting the shelf engaging end 26 to the shelf 12 can be contemplated. For example, the display device receiving portion 32 may comprise a perforated portion (not shown) in place of a lined recess 32 with holes at specific positions. The shelf engaging end 26 can therefore include pegs or clips (not shown) which are capable of being inserted into the holes of the perforated portion to be anchored therein. In another embodiment the shelf engaging end may also carry a magnet (not shown) to be magnetically engaged within the magnetic or metallic lined recess 32.

Hence, when the user wishes to change the position of the display device 10 on the shelf 12, the user will lift up the leg member 34 from the shelf 12 and slide the display device 10 along the track rail 30 to a desired position where the shelf engaging end 26 will be mounted to the lined recess 32.

The curved article retaining element or portion 36 of the present display device comprises an article receiving side 40. This article receiving side has a concave curvature to receive articles thereon. In this way the curved article retaining portion 36 can retain adjacent articles such as photo albums 22, which have a back side 42 that is greater in dimension than their front side 44, along the width W of the shelf 12. Preferably, the length of the curved article retaining portion 36 is sufficient to receive a set 20 of about five conventionally sized photo albums 22. It is also preferable to place about two to three sets 20 of albums 22 on a single shelf 12 with the sets 20 placed relatively close to one another for display.

In the non-limiting example shown in FIGS. 1 and 2, the leg member 34, under the form of an upstanding portion, rises up to about a third 46 of the height of the photo albums 22. In this way the curved article retaining portion 36, shown here under the form of a horizontal member, runs across height 46 in order to retain a display set 20 of photo albums 22 with sufficient stability. Hence, the track rail 30 will also be mounted on the back structure 18 to a distance above the shelf 12 that corresponds to about a third 46 of the height of the photo albums 22. Other ways of providing stability to a set 20 of photo albums 22 such as providing a curved article retaining portion 36 that run diagonally accros the albums 22 may also be contemplated.

Again in the current example, the curved article retaining portion 36 and the leg member or upstanding portion 34 form a corner 38 therebetween. This corner 38 may be inwardly directed to hold, along with the upstanding portion 34, the edge 48 of the outermost photo album 50.

The shelf 12 may also carry a track rail 31 at its front edge 14. A second shelf (not shown) may be placed below shelf 12. This second shelf will therefore comprise a width which is about double the width W of shelf 12. In this way, the display device 10 may be used in conjunction with this second shelf and the back structure engaging end 24 may be mounted to the front edge track rail 31.

In another embodiment the shelf 12 may comprise a back display device receiving portion (not shown) near the back edge 16. This back edge display receiving portion may be a lined recess similar to lined recess 32. The display device 10 may therefore, comprise a support member in the form of a substantially vertical upstanding back portion (not shown) instead of a free end 24. This vertical upstanding back portion may be similar to the upstanding front portion 34. This upstanding back portion may include a back edge engaging end (not shown), similar to the front edge engaging end 26, which can be snugly fitted in the back edge linear recess.

Although the present invention has been hereinabove by way of preferred embodiments thereof, it can be modified, without departing from the spirit and nature of the subject invention as defined in the appended claims.

What is claimed is:

1. An article display device adapted for use with a shelving structure including a flat shelf having front and back edges, said display device comprising:

an article retaining element including an article-engaging side having a concavely curved configuration for engaging articles thereon, said article retaining element being spaced above the shelf and being connected to the shelving structure and spanning a length equal to about the distance between the front edge and back edges of the shelf, and support members for connecting said article retaining element to the shelving structure, for spacing said article retaining element above the shelf, wherein when said display device is mounted to the shelving structure articles to be displayed are placed on the shelf side by side along the article-engaging side.

2. An article display device according to claim 1, wherein the articles are photo albums.

3. An article display device according to claim 1 wherein the article retaining element is substantially diagonal with respect to the plane of the shelf and wherein the support members include opposite free ends of the article retaining element and the shelving structure further includes a backboard, wherein one said free end is mounted to the shelf and the other free end is mounted to the backboard.

4. An article display device according to claim 1 wherein said article retaining element is a substantially horizontal member, wherein one of said support members is a leg member mounted to the horizontal member, said leg member being mounted to the shelf.

5. An article display device according to claim 4 wherein said shelving structure further includes a backboard and wherein another of said support members is a free end of the horizontal member, said free end being mounted to the backboard.

6. An article display device mountable on a flat shelf having a front edge and a back edge adjacent to a back structure, said display device comprising:

a substantially vertical upstanding portion having a shelf engaging end for being mounted near the front edge of the shelf, said upstanding portion substantially vertically upstanding from the shelf when mounted thereto; and a substantially horizontal article retaining portion comprising a back structure engaging end and spanning a length equal to about the distance between the back structure engaging end and the upstanding portion, said article retaining portion comprising an article-engaging side having a concavely curved configuration for articles to be engaged thereon, wherein when said article display device is mounted to the shelf, articles to be displayed are placed on the shelf adjacent to one another along the article-engaging side.

7. An article display device according to claim 6, further comprising a track rail mountable to the back structure, said back structure engaging end including a connector said track rail being configured and sized to slidably receive the connector when mounted to the back structure.

8. An article display device according to claim 7, wherein the back structure includes an upper shelf having an front edge carrying the track rail.

9. An article display device according to claim 7, wherein the connector comprises a snap member.

10. An article display device according to claim 7, wherein the connector comprises a magnet and the track rail comprises a magnetic or metallic portion for mutual magnetic engagement therewith.

11. An article display device according to claim 6, wherein the shelf includes a display device receiving portion near the front edge to releasably mount the shelf-engaging end thereto.

12. An article display device according to claim 11, wherein the display device receiving portion comprises a lined recess near the front edge of the shelf for snugly fitting the shelf-engaging end therein.

13. An article display device according to claim 11, wherein the shelf-engaging end comprises a magnet and the display device receiving portion comprises a metallic or magnetic portion for mutual magnetic engagement therewith.

14. An article display device according to claim 6, wherein the articles are photo albums.

15. An article display device mountable to a flat shelf having a front edge and an opposite back edge, said display device comprising:

a substantially vertical upstanding front portion having a free front edge engaging end for being mounted near the front edge of the shelf, said front edge upstanding portion substantially vertically upstanding from the shelf when mounted thereto;

a substantially vertical upstanding back portion having a free back edge engaging end for being mounted near the back edge of the shelf, said front back edge upstanding portion substantially vertically upstanding from the shelf when mounted thereto; and a substantially horizontal article retaining portion spanning a length equal to about the distance between said upstanding front and back portions, said article retaining portion comprising an article-engaging side having a concavely curved configuration for articles to be engaged thereon, wherein when said display device is mounted to the shelf, articles to be displayed are placed on the shelf adjacent to one another along the article-engaging side.

16. An article display device according to claim 15, wherein the shelf includes a front display device receiving portion near the front edge to releasably mount the front edge end thereto and a back display device receiving portion near the back edge to releasably mount the back edge end thereto.

17. An article display device according to claim 15, wherein the front and back display device receiving portions are respective lined recesses near the front edge and back edge respectively for snuggly fitting the front edge end and the back edge end therein respectively.

18. An article display device according to claim 15, wherein the articles are photo albums.

19. An article display device and shelf structure combination comprising:

a shelf structure including:

a flat shelf having a front edge and a back edge; and a back structure adjacent to said back edge;

a display device including:

a substantially vertical upstanding portion having a shelf engaging end for being mounted near said flat shelf front edge, said upstanding portion substantially vertically upstanding from said flat shelf; and a substantially horizontal article retaining portion having a back structure engaging end and spanning a length equal to about the distance between said back structure engaging end and said vertical upstanding portion, said article retaining portion having a concavely curved article-engaging side for articles to be engaged thereon, wherein, articles to be displayed are placed on said flat shelf adjacent to one another along the article-engaging side.

20. A combination according to claim 19 wherein, said back structure engaging end includes a connector and said back structure includes a track rail mounted thereto for slidably receiving the connector.

21. A combination according to claim 20, wherein said shelf structure further includes an upper flat shelf mounted to said back structure, said upper flat shelf having an upper shelf front edge carrying the track rail.

22. An article display device according to claim 19, wherein the shelf includes a display device receiving portion near the front edge to releasably mount the shelf-engaging end thereto.

23. An article display device according to claim 22, wherein the display device receiving portion comprises a lined recess near the front edge of the shelf for snugly fitting the shelf-engaging end therein.

24. An article display device according to claim 19, wherein the articles are photo albums.

25. An article display device and shelving structure combination comprising:

a shelving structure including a flat shelf having a front edge and an opposite back edge; and a display device including:

a substantially vertical upstanding front portion having a free front edge engaging end for being mounted near said flat shelf front edge, said front edge upstanding portion substantially vertically upstanding from said flat shelf, a substantially vertical upstanding back portion having a free back edge engaging end for being mounted near said flat shelf back edge, said front back edge upstanding portion substantially vertically upstanding from said flat shelf; and a substantially horizontal article retaining portion spanning a length equal to about the distance between said upstanding front and back portions, said article retaining portion comprising an article-engaging side having a concavely curved configuration for articles to be engaged thereon, wherein articles to be displayed are placed on the shelf adjacent to one another along the article-engaging side.

26. A combination according to claim 25, wherein said flat shelf includes a front display device receiving portion near the front edge to releasably mount the front edge end thereto and a back display device receiving portion near the back edge to releasably mount the back edge end thereto.

27. An article display device according to claim 26, wherein said front and back display device receiving portions are respective lined recesses near the front edge and back edge respectively for snuggly fitting the front edge end and the back edge end therein respectively.

28. An article display device according to claim 25, wherein the articles are photo albums.

* * * * *